US008850949B1

(12) United States Patent
Lopez

(10) Patent No.: US 8,850,949 B1
(45) Date of Patent: Oct. 7, 2014

(54) SAFETY DOOR FOR CLASSROOMS AND THE LIKE

(71) Applicant: Lois A. Lopez, San Jose, CA (US)

(72) Inventor: Lois A. Lopez, San Jose, CA (US)

( * ) Notice: Subject to any disclaimer, the term of this patent is extended or adjusted under 35 U.S.C. 154(b) by 35 days.

(21) Appl. No.: 13/870,633

(22) Filed: Apr. 25, 2013

(51) Int. Cl.
*F41H 5/24* (2006.01)

(52) U.S. Cl.
CPC ..... *F41H 5/24* (2013.01)
USPC ..... 89/36.04; 89/36.02; 89/920; 109/49.5

(58) Field of Classification Search
CPC ..... F41H 5/24; F41H 5/26; F41H 5/013; F41H 5/06
USPC ..... 89/36.02, 36.04, 36.05, 36.06, 36.08, 89/920; 109/49.5
See application file for complete search history.

(56) References Cited

U.S. PATENT DOCUMENTS 3,751,100 A * 8/1973 Keyes ..... 150/168
4,249,589 A * 2/1981 Loeb ..... 160/368.1
5,004,286 A 4/1991 Taylor, III et al.
5,487,323 A 1/1996 Madden, Jr.
5,533,778 A 7/1996 Sheridan
5,580,204 A 12/1996 Hultman
5,619,820 A 4/1997 Madden, Jr.
5,703,316 A * 12/1997 Madden, Jr. ..... 296/1.07
5,939,658 A * 8/1999 Muller ..... 89/36.04
6,240,858 B1 * 6/2001 Mandall ..... 109/49.5
6,298,766 B1 * 10/2001 Mor ..... 89/36.04
6,308,474 B1 10/2001 Wilson
6,568,310 B2 * 5/2003 Morgan ..... 89/36.02
6,588,705 B1 * 7/2003 Frank ..... 244/118.5
6,711,980 B2 * 3/2004 Kropf ..... 89/36.09
6,807,890 B1 * 10/2004 Fuqua ..... 89/36.02
6,823,627 B1 11/2004 Ben-Ezra
6,871,821 B2 * 3/2005 Takahama ..... 244/129.5
7,124,675 B1 * 10/2006 Sand ..... 89/36.07
7,159,503 B1 * 1/2007 Weatherwax ..... 89/36.04
7,389,718 B1 * 6/2008 Carter et al. ..... 89/36.02
7,918,167 B2 * 4/2011 Tanielian et al. ..... 109/49.5
8,069,769 B2 * 12/2011 Carberry et al. ..... 89/36.02
8,161,710 B2 * 4/2012 Elliott et al. ..... 52/745.05
8,528,864 B2 * 9/2013 Villanueva Montero .. 244/129.1
8,667,880 B1 * 3/2014 Berman ..... 89/36.08
8,671,820 B1 * 3/2014 Keyfauver et al. ..... 89/36.05
8,695,476 B2 * 4/2014 Kucherov et al. ..... 89/36.02
8,701,544 B2 * 4/2014 Peters et al. ..... 89/918
2002/0092416 A1 * 7/2002 Cohen et al. ..... 89/36.05
2003/0080248 A1 5/2003 Morgan
2003/0213359 A1 * 11/2003 Kropf ..... 89/36.09
2006/0230916 A1 * 10/2006 Sand ..... 89/36.07
2006/0240391 A1 * 10/2006 Sovine et al. ..... 434/219
2008/0047419 A1 * 2/2008 Thompson ..... 89/36.02
2008/0086952 A1 * 4/2008 Holwick ..... 52/3
2008/0263958 A1 * 10/2008 Edson ..... 49/56

(Continued)

*Primary Examiner* — Bret Hayes
*Assistant Examiner* — Joshua Freeman
(74) *Attorney, Agent, or Firm* — Richard L Miller

(57) ABSTRACT

A door safety shield that completely overlies a door having a frame and a doorknob, replaceabley and slidably attaches to the frame of the door and not the door so as to eliminate damage to the door, and prevents unauthorized opening of the door. The door safety shield includes a sheet and bolt assemblies. The sheet completely overlies the door. The bolt assemblies are affixed to the sheet, replaceabley and slidably attach to the frame of the door and not the door so as to eliminate the damage to the door, and prevent the unauthorized opening of the door.

10 Claims, 4 Drawing Sheets

(56) References Cited

U.S. PATENT DOCUMENTS

Figure 1:
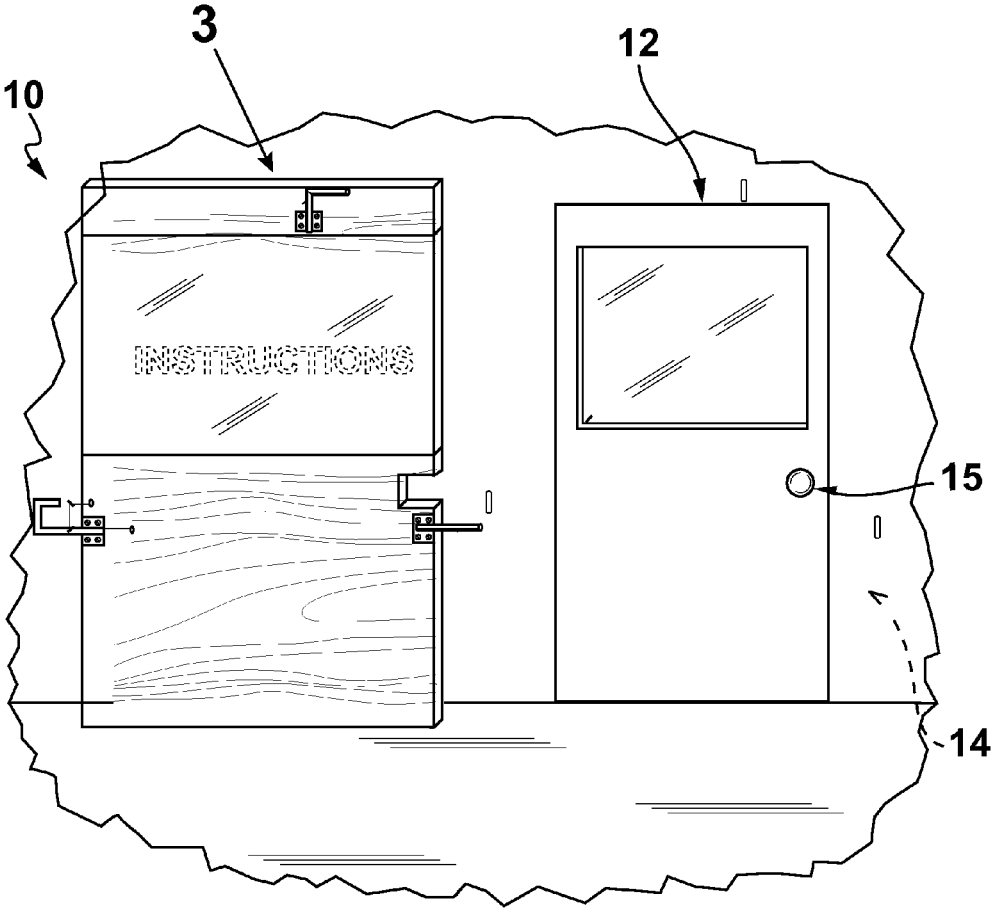

2009/0313902 A1* 12/2009 Brisbois et al. ..... 49/460
2010/0257788 A1 10/2010 McRoskey
2011/0203179 A1 8/2011 Boens
2012/0279383 A1* 11/2012 Carberry et al. ..... 89/36.02

* cited by examiner

SAFETY DOOR FOR CLASSROOMS AND THE LIKE

1. BACKGROUND OF THE INVENTION

A. Field of the Invention

The embodiments of the present invention relate to a door safety shield, and more particularly, the embodiments of the present invention relate to a door safety shield for completely overlying a door having a frame and a doorknob, for replaceabley and slidably attaching to the frame of the door and not the door so as to eliminate damage to the door, and for preventing unauthorized opening of the door.

B. Description of the Prior Art

We are in a state in which the safety of our children at school is at risk. Offices, banks, stores, police officers, and homes all take protection against gun violence, but when it comes to our schools, our children do not have the right protection.

Thus, there exists a need for a door safety shield for completely overlying a door having a frame and a doorknob, for replaceabley and slidably attaching to the frame of the door and not the door so as to eliminate damage to the door, and for preventing unauthorized opening of the door.

Numerous innovations for door/window safety shields and related fastener and support assemblies have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a door safety shield for completely overlying a door having a frame and a doorknob, for replaceabley and slidably attaching to the frame of the door and not the door so as to eliminate damage to the door, and for preventing unauthorized opening of the door.

(1) U.S. Pat. No. 5,004,286 to Taylor, III et al.

U.S. Pat. No. 5,004,286—issued to Taylor, III et al. on Apr. 2, 1991 in U.S. class 296 and subclass 24.46—teaches a transport vehicle protective shield formed of a transparent, multi-layered, and bullet-proof paneling, which includes a first panel orthogonally mounted to a second panel to enclose a passenger compartment of a transport vehicle, such as a bus. The second panel includes a displacement door hingedly mounted to a first door of the second panel to provide access for a coin receiving appliance traditionally positioned adjacent the passenger compartment in bus vehicles. The panels include ventilation apertures to cooperate with a ventilation duct work within the passenger compartment to provide comfort and convenience in its use.

(2) U.S. Pat. No. 5,487,323 to Madden, Jr.

U.S. Pat. No. 5,487,323—issued to Madden, Jr. on Jan. 30, 1996 in U.S. class 89 and subclass 36.08—teaches a removable bullet resistant apparatus for windshields and rear windows of a vehicle, which includes a transparent panel that is disposed against structural elements of a vehicle, and a layered mat is secured to the bottom portion of the transparent panel and disposed on the dashboard deck in front of the transparent panel for the windshield embodiment, and behind the transparent panel and on the rear deck for the rear window embodiment. The transparent panels and the mats are bullet resistant. The layered mats are secured to the transparent panels in an overlapping relationship. The mats are made of layers of bullet resistant material, woven, nonwoven, or combinations of both woven and nonwoven materials.

(3) U.S. Pat. No. 5,533,778 to Sheridan.

U.S. Pat. No. 5,533,778—issued to Sheridan on Jul. 9, 1996 in U.S. class 296 and subclass 152—teaches a window shield including a transparent projectile resistant panel mounted on the inside of a vehicle door frame covering the window opening, and a removable bracket support connected to the panel. An additional panel can be fastened by snaps to the bracket support to protect the lower portion of a driver's body if necessary.

(4) U.S. Pat. No. 5,580,204 to Hultman.

U.S. Pat. No. 5,580,204—issued to Hultman on Dec. 3, 1996 in U.S. class 411 and subclass 509—teaches a fastener assembly and method for attaching a first member to a second member. The fastener assembly includes a socket member that defines a socket, and a stud that includes a head engagable with the socket of the nut. The stud is attached to a first member, and the nut is attached to a second member. The assembly is initially attached to the first member by attaching the stud to the first member and then inserting the nut into the second member. When the first member must be removed from the second member, the head of the stud is forcibly disengaged from the socket of the nut. Re-attachment of the first member to the second member is achieved by forcibly engaging the head with the socket. After the initial insertion, the socket member remains captively retained on the second member.

(5) U.S. Pat. No. 5,619,820 to Madden, Jr.

U.S. Pat. No. 5,619,820—issued to Madden, Jr. on Apr. 15, 1997 in U.S. class 49 and subclass 50—teaches a support apparatus for supporting a transparent bullet resistant panel on a door having no frame for its window, which includes channel elements for holding the transparent panel, support elements including brackets secured to the channel elements and disposed against the inside of the door, and support elements extending downwardly within the door.

(6) U.S. Pat. No. 6,308,474 to Wilson.

U.S. Pat. No. 6,308,474—issued to Wilson on Oct. 30, 2001 in U.S. class 52 and subclass 202—teaches a door and doorway shield system, each including at least one hook for hanging or gripping onto a portion of the door or the doorway. The shield, preferably, hangs on the door by a J-shaped hook portion that extends substantially along the entire top edge of the shield. The shield, preferably, includes a protective portion that extends across the space between a door and a doorway and across the trim molding of the doorway to substantially cover, or hook on, the front trim molding of the doorway. In embodiments that hook on the trim molding, the trim hook holds the shield in place to provide resistance to impacts pushing the shield off of the door. A J-shaped hook portion on the bottom of the shield allows for connection to the bottom of the door or for turning the shield up-side-down for use on both left-hinged and right-hinged doors.

(7) United States Patent Application Publication Number 2003/0080248 to Morgan.

United States Patent Application Publication Number 2003/0080248—published to Morgan on May 1, 2003 in U.S. class 244 and subclass 118.5—teaches a layer of a mesh or mail material is bonded to the opposite sides of a ballistic layer of a bullet resistant composite material. The layer of relatively lightweight body material, e.g., structural honeycomb, is bonded to the outside of each layer of mesh or mail material. A ballistic layer is provided on the outside of each layer of relatively lightweight body material. Adhesive material secures the layers together to provide a unified panel.

(8) U.S. Pat. No. 6,823,627 to Ben-Ezra.

U.S. Pat. No. 6,823,627—issued to Ben-Ezra on Nov. 30, 2004 in U.S. class 49 and subclass 394—teaches a method and kit for retrofitting security doors to facilitate escaping from buildings during emergencies. It applies to new security doors, as well as existing security doors. It is molded from a corrosion resistant plastic. Only basic hand tools are required for retrofitting existing doors. The kit includes a simple separable shield having a thin outer wall portion for enclosing an unlocking member, and an orthogonal portion for retaining the shield in a security door. In one aspect, the shield is mounted in fixed relationship to the security door. In a second aspect, the shield is mounted in rotating relationship to the security door. The method includes the steps of removing a lock member, installing the shield, and re-installing the lock member.

(9) United States Patent Application Publication Number 2010/0257788 to McRoskey.

United States Patent Application Publication Number 2010/0257788—published to McRoskey on Oct. 14, 2010 in U.S. class 49 and subclass 383—teaches a door safety shield that generally includes door and door jamb attachment portions and at least one tambour portion extending therebetween. The tambour portion includes a plurality of tambour slats hingedly coupled to one another so as to be substantially flexible in a first direction and substantially inflexible in a second direction. The first tambour portion is coupled to the door attachment portion and/or the door jamb attachment portion by a coupling that is substantially flexible in the second direction and substantially inflexible in the first direction. Methods of preventing injuries at the hinged side of a door and methods of manufacturing a door safety shield are also taught.

(10) United States Patent Application Publication Number 2011/0203179 to Boens.

United States Patent Application Publication Number 2011/0203179—published to Boens on Aug. 25, 2011 in U.S. class 49 and subclass 142—teaches a door assembly including a custom-built doorframe housing a main door that carries an integrally mounted and rectangularly-shaped leaf door. The trailing edge of the main door rotates about a vertical axis that is parallel to and proximate the inner rear surface of the doorframe. The leaf door is rotatably attached by a spring mechanism to a cutout excised from the leading edge of the main door. As the main door rotates about its vertical axis, the leaf door is restrained by tension of the spring mechanism from closing with full force upon human fingers or any other object that may be proximate the door jamb or inner doorframe area. The pivoting or trailing edge of the main door is abutted against elastomeric material affixed to the inner rear surface of the doorframe, thereby preventing the insertion of fingers into what otherwise would be a hazardous gap.

It is apparent that numerous innovations for door/window safety shields and related fastener and support assemblies have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a door safety shield for completely overlying a door having a frame and a doorknob, for replaceabley and slidably attaching to the frame of the door and not the door so as to eliminate damage to the door, and for preventing unauthorized opening of the door.

2. SUMMARY OF THE INVENTION

Thus, an object of the embodiments of the present invention is to provide a door safety shield for completely overlying a door having a frame and a doorknob, for replaceabley and slidably attaching to the frame of the door and not the door so as to eliminate damage to the door, and for preventing unauthorized opening of the door, which avoids the disadvantages of the prior art.

Briefly stated, another object of the embodiments of the present invention is to provide a door safety shield that completely overlies a door having a frame and a doorknob, replaceabley and slidably attaches to the frame of the door and not the door so as to eliminate damage to the door, and prevents unauthorized opening of the door. The door safety shield includes a sheet and bolt assemblies. The sheet completely overlies the door. The bolt assemblies are affixed to the sheet, replaceabley and slidably attach to the frame of the door and not the door so as to eliminate the damage to the door, and prevent the unauthorized opening of the door.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

Figure 2:
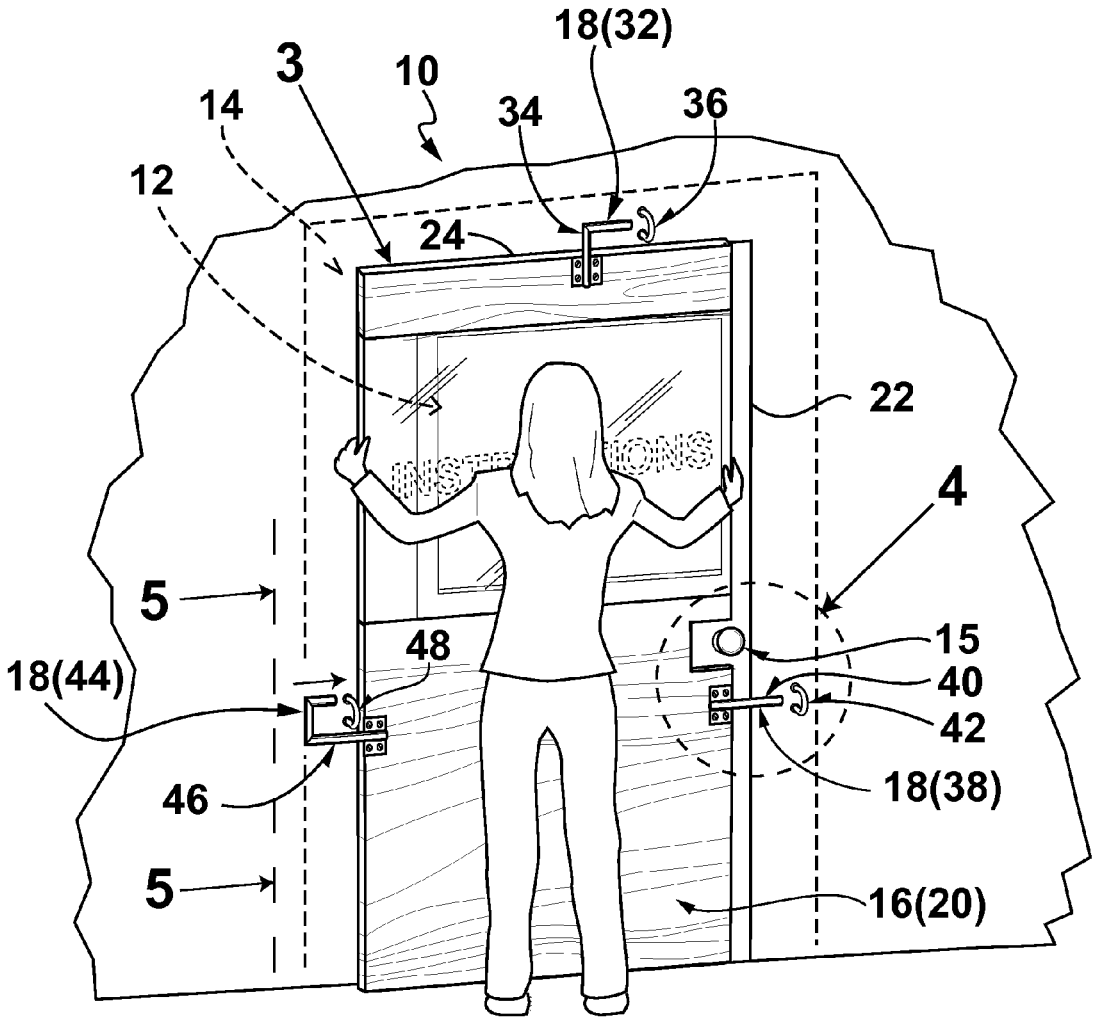
Figure 3:
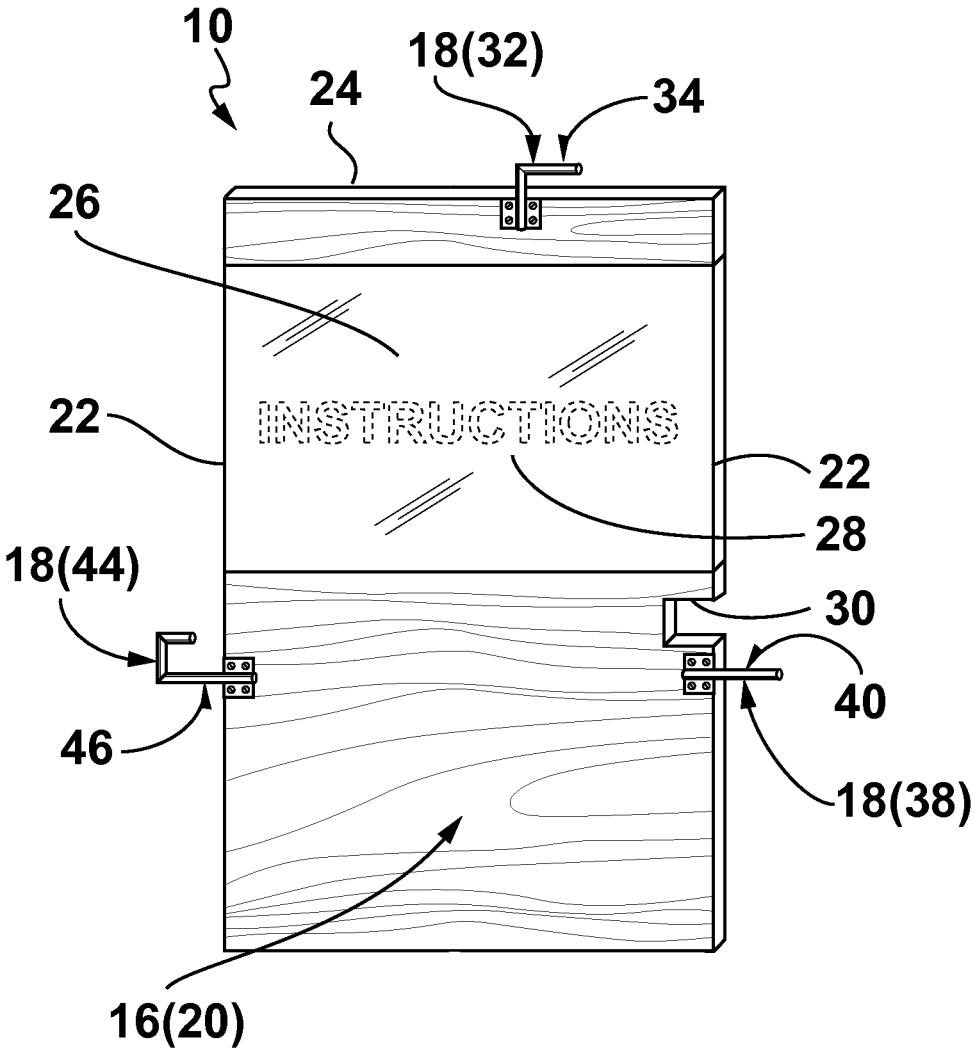
Figure 4:
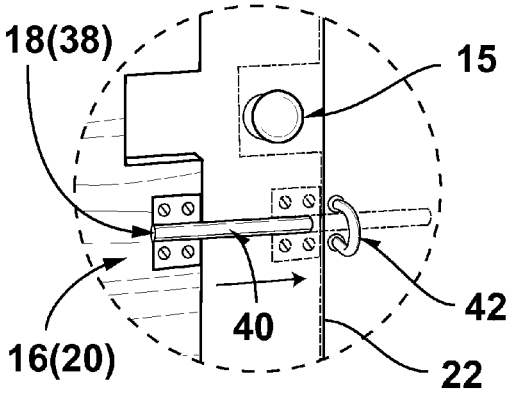
Figure 5:
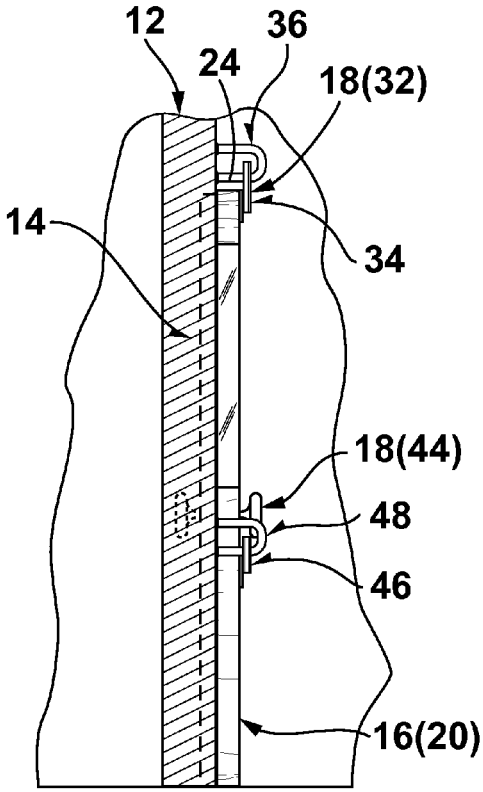

The figures of the drawing are briefly described as follows:

FIG. 1 is a diagrammatic perspective view of the door safety shield of the embodiments of the present invention prior to completely overlying a door having a frame and a doorknob, replaceabley and slidably attaching to the frame of the door and not the door so as to eliminate damage to the door, and preventing unauthorized opening of the door, FIG. 2 is a diagrammatic perspective view of the door safety shield of the embodiments of the present invention completely overlying a door having a frame and a doorknob, replaceabley and slidably attaching to the frame of the door and not the door so as to eliminate damage to the door, and preventing unauthorized opening of the door, FIG. 3 is an enlarged diagrammatic perspective view of the door safety shield of the embodiments of the present invention identified by ARROW 3 in FIGS. 1 and 2;

FIG. 4 is an enlarged diagrammatic perspective view of the area generally enclosed by the dotted curve identified by ARROW 4 in FIG. 2 of a bolt assembly of the door safety shield of the embodiments of the present invention; and FIG. 5 is an enlarged diagrammatic cross sectional view taken along LINE 5-5 in FIG. 2 of other bolt assemblies of the door safety shield of the embodiments of the present invention.

4. LIST OF REFERENCE NUMERALS UTILIZED IN THE FIGURES OF THE DRAWING

A. Introductory

10 door safety shield of embodiments of present invention for completely overlying door 12 having frame 14 and doorknob 15, for replaceabley and slidably attaching to frame 14 of door 12 and not door 12 so as to eliminate damage to door 12, and for preventing unauthorized opening of door 12

12 door

14 frame of door 12

15 door knob of door 12

B. Overall Configuration of Door Safety Shield 10

16 sheet for completely overlying door 12
18 bolt assemblies for replaceabley and slidably attaching to frame 14 of door 12 and not door 12 so as to eliminate damage to door 12 and for preventing unauthorized opening of door 12

C. Specific Configuration of Sheet 16

20 bullet-proof sheet of sheet 16
22 pair of long vertical sides of bullet-proof sheet 20 of sheet 16
24 short horizontal top of bullet-proof sheet 20 of sheet 16
26 bullet-proof window of bullet-proof sheet 20 of sheet 16
28 instructions on bullet-proof window 26 of bullet-proof sheet 20 of sheet 16
30 cutout in bullet-proof sheet 20 of sheet 16 for providing clearance for doorknob 15 of door 12

D. Specific Configuration of Bolt Assemblies 18

32 first bolt assembly of bolt assemblies 18
34 right-angled rod of first bolt assembly 32 of bolt assemblies 18
36 catch of first bolt assembly 32 of bolt assemblies 18 for affixing to frame 14 of door 12, above door 12, so as to allow right-angled rod 34 of first bolt assembly 32 of bolt assemblies 18 to slide to right into catch 36 of first bolt assembly 32 of bolt assemblies 18 when door safety shield 10 is slid to right
38 second bolt assembly of bolt assemblies 18
40 straight rod of second bolt assembly 38 of bolt assemblies 18
42 catch of second bolt assembly 38 of bolt assemblies 18 for affixing to frame 14 of door 12, to right of door 12, so as to allow straight rod 40 of second bolt assembly 38 of bolt assemblies 18 to slide to right and into catch 42 of second bolt assembly 38 of bolt assemblies 18 when door safety shield 10 is slid to right
44 third bolt assembly of bolt assemblies 18
46 J-shaped rod of third bolt assembly 44 of bolt assemblies 18
48 catch of third bolt assembly 44 of bolt assemblies 18 for affixing to frame 14 of door 12, to left of door 12, so as to allow J-shaped rod 46 of third bolt assembly 44 of bolt assemblies 18 to slide to right and into catch 48 of third bolt assembly 44 of bolt assemblies 18 when door safety shield 10 is slid to right

5. DETAILED DESCRIPTION OF THE PREFERRED EMBODIMENTS

A. Introductory

Referring now to the figures, in which like numerals indicate like parts, and particularly to FIGS. 1 and 2, which are, respectively, a diagrammatic perspective view of the door safety shield of the embodiments of the present invention prior to completely overlying a door having a frame and a doorknob, replaceabley and slidably attaching to the frame of the door and not the door so as to eliminate damage to the door, and preventing unauthorized opening of the door, and a diagrammatic perspective view of the door safety shield of the embodiments of the present invention completely overlying a door having a frame and a doorknob, replaceabley and slidably attaching to the frame of the door and not the door so as to eliminate damage to the door, and preventing unauthorized opening of the door, the door safety shield of the embodiments of the present invention is shown generally at 10 for completely overlying a door 12 having a frame 14 and a doorknob 15, for replaceabley and slidably attaching to the frame 14 of the door 12 and not the door 12 so as to eliminate damage to the door 12, and for preventing unauthorized opening of the door 12.

B. Overall Configuration of the Door Safety Shield 10

The overall configuration of the door safety shield 10 can best be seen in FIG. 3, which is an enlarged diagrammatic perspective view of the door safety shield of the embodiments of the present invention identified by ARROW 3 in FIGS. 1 and 2, and as such, will be discussed with reference thereto.

The door safety shield 10 comprises a sheet 16 and bolt assemblies 18. The sheet 16 is for completely overlying the door 12. The bolt assemblies 18 are affixed to the sheet 16, are for replaceabley and slidably attaching to the frame 14 of the door 12 and not the door 12 so as to eliminate the damage to the door 12, and are for preventing the unauthorized opening of the door 12.

C. Specific Configuration of the Sheet 16

The sheet 16 is a bullet-proof sheet 20.

The bullet-proof sheet 20 of the sheet 16 is rectangular-shaped, and as such, has a pair of long vertical sides 22 and a short horizontal top 24.

The bullet-proof sheet 20 of the sheet 16 further has a bullet-proof window 26.

The bullet-proof window 26 of the bullet-proof sheet 20 displays instructions 28 thereon.

The instructions 28 on the bullet-proof window 26 of the bullet-proof sheet 20 of the sheet 16 include:

Lock all doors;
Turn off all lights;
Use barricades against the door;
Be very quiet;
Do not answer the door until told by the Supervisor; and
Be safe sit on the floor in a corner.

The bullet-proof sheet 20 of the sheet 16 has a cutout 30.

The cutout 30 in the bullet-proof sheet 20 of the sheet 16 opens into, and extends inwardly from, one long vertical side 22 of the bullet-proof sheet 20 of the sheet 16, and is for providing clearance for the doorknob 15 of the door 12.

D. Specific Configuration of the Bolt Assemblies 18

The specific configuration of the bolt assemblies 18 can best be seen in FIGS. 2-5, which are, respectively, again, a diagrammatic perspective view of the door safety shield of the embodiments of the present invention completely overlying a door having a frame and a doorknob, replaceabley and slidably attaching to the frame of the door and not the door so as to eliminate damage to the door, and preventing unauthorized opening of the door, again, an enlarged diagrammatic perspective view of the door safety shield of the embodiments of the present invention identified by ARROW 3 in FIGS. 1 and 2, an enlarged diagrammatic perspective view of the area generally enclosed by the dotted curve identified by ARROW 4 in FIG. 2 of a bolt assembly of the door safety shield of the embodiments of the present invention, and an enlarged diagrammatic cross sectional view taken along LINE 5-5 in FIG. 2 of other bolt assemblies of the door safety shield of the embodiments of the present invention, and as such, will be discussed with reference thereto.

The bolt assemblies 18 comprise a first bolt assembly 32.

The first bolt assembly 32 of the bolt assemblies 18 comprises a right-angled rod 34.

The right-angled rod 34 of the first bolt assembly 32 of the bolt assemblies 18 extends vertically upwardly from, and is affixed to, the short horizontal top 24 of the bullet-proof sheet 20 of the sheet 16, and then turns right.

The first bolt assembly 32 of the bolt assemblies 18 further comprises a catch 36. The catch 36 of the first bolt assembly 32 of the bolt assemblies 18 is for affixing to the frame 14 of the door 12, above the door 12, so as to allow the right-angled rod 34 of the first bolt assembly 32 of the bolt assemblies 18 to slide to the right and into the catch 36 of the first bolt assembly 32 of the bolt assemblies 18 when the door safety shield 10 is slid to the right.

The bolt assemblies 18 further comprise a second bolt assembly 38.

The second bolt assembly 38 of the bolt assemblies 18 comprises a straight rod 40.

The straight rod 40 of the second bolt assembly 38 of the bolt assemblies 18 extends horizontally outwardly from, and is affixed to, the one long vertical side 22 of the bullet-proof sheet 20 of the sheet 16.

The second bolt assembly 38 of the bolt assemblies 18 further comprises a catch 42. The catch 42 of the second bolt assembly 38 of the bolt assemblies 18 is for affixing to the frame 14 of the door 12, to the right of the door 12, so as to allow the straight rod 40 of the second bolt assembly 38 of the bolt assemblies 18 to slide to the right and into the catch 42 of the second bolt assembly 38 of the bolt assemblies 18 when the door safety shield 10 is slid to the right.

The bolt assemblies 18 further comprise a third bolt assembly 44.

The third bolt assembly 44 of the bolt assemblies 18 comprises a J-shaped rod 46.

The J-shaped rod 46 of the third bolt assembly 44 of the bolt assemblies 18 extends horizontally outwardly from, and is affixed to, the other long vertical side 22 of the bullet-proof sheet 20 of the sheet 16, then turns up, and then turns to the right.

The third bolt assembly 44 of the bolt assemblies 18 further comprises a catch 48. The catch 48 of the third bolt assembly 44 of the bolt assemblies 18 is for affixing to the frame 14 of the door 12, to the left of the door 12, so as to allow the J-shaped rod 46 of the third bolt assembly 44 of the bolt assemblies 18 to slide to the right and into the catch 48 of the third bolt assembly 44 of the bolt assemblies 18 when the door safety shield 10 is slid to the right.

E. Impressions

It will be understood that each of the elements described above, or two or more together, may also find a useful application in other types of constructions differing from the types described above.

While the embodiments of the present invention have been illustrated and described as embodied in a door safety shield for completely overlying a door having a frame and a doorknob, for replaceabley and slidably attaching to the frame of the door and not the door so as to eliminate damage to the door, and for preventing unauthorized opening of the door, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A door safety shield for completely overlying a door having a frame and a doorknob, for replaceabley and slidably attaching to the frame of the door and not the door so as to eliminate damage to the door, and for preventing unauthorized opening of the door, said door safety shield comprising:

a) a rectangular-shaped bullet-proof sheet for completely overlying the door, with a pair of long vertical sides, a short horizontal top, and a cutout that opens into one long vertical side of said bullet proof sheet;

b) bolt assemblies comprising a first bolt assembly, a second bolt assembly and a third bolt assembly; wherein said first bolt assembly is affixed to said short horizontal top of said bullet-proof sheet and comprises a right-angled rod that extends vertically upwardly from said short horizontal top of said bullet-proof sheet, and then turns right; wherein said second bolt assembly is affixed to said one long vertical side of said bullet-proof sheet and comprises a straight rod that extends horizontally outwardly from said one long vertical side of said bullet-proof sheet; wherein said third bolt assembly is affixed to the other long vertical side of said bullet-proof sheet and comprises a J-shaped rod that extends horizontally outwardly from the other long vertical side of said bullet-proof sheet of said sheet;

wherein said bolt assemblies are for replaceabley and slidably attaching to the frame of the door and not the door so as to eliminate damage to the door; and wherein said bolt assemblies are for preventing the unauthorized opening of the door.

2. The door safety shield of claim 1, wherein said bullet-proof sheet of said sheet has a bullet-proof window.

3. The door safety shield of claim 2, wherein said bullet-proof window of said bullet-proof sheet displays instructions thereon.

4. The door safety shield of claim 1, wherein said cutout in said bullet-proof sheet of said sheet opens into one long vertical side of said bullet-proof sheet of said sheet.

5. The door safety shield of claim 1, wherein said first bolt assembly of said bolt assemblies comprises a catch.

6. The door safety shield of claim 5, wherein said catch of said first bolt assembly of said bolt assemblies is for affixing to the frame of the door, above the door, so as to allow said right-angled rod of said first bolt assembly of said bolt assemblies to slide to the right and into said catch of said first bolt assembly of said bolt assemblies when said door safety shield is slid to the right.

7. The door safety shield of claim 1, wherein said second bolt assembly of said bolt assemblies comprises a catch.

8. The door safety shield of claim 7, wherein said catch of said second bolt assembly of said bolt assemblies is for affixing to the frame of the door, to the right of the door, so as to allow said straight rod of said second bolt assembly of said bolt assemblies to slide to the right and into said catch of said second bolt assembly of said bolt assemblies when said door safety shield is slid to the right.

9. The door safety shield of claim 1, wherein said third bolt assembly of said bolt assemblies comprises a catch.

10. The door safety shield of claim 9, wherein said catch of said third bolt assembly of said bolt assemblies is for affixing to the frame of the door, to the left of the door, so as to allow said J-shaped rod of said third bolt assembly of said bolt assemblies to slide to the right and into said catch of said third bolt assembly of said bolt assemblies when said door safety shield is slid to the right.

* * * * *